United States Patent [19]

Inada

[11] 4,452,030

[45] Jun. 5, 1984

[54] CONTAMINATION-FREE METHOD AND APPARATUS FOR FILLING SPOUTED BAGS WITH A FLUID

[75] Inventor: Junji Inada, Tokyo, Japan

[73] Assignee: Dai Nippon Insatsu Kabushiki Kaisha, Japan

[21] Appl. No.: 508,198

[22] Filed: Jun. 27, 1983

Related U.S. Application Data

[62] Division of Ser. No. 230,705, Feb. 2, 1981.

[30] Foreign Application Priority Data

Feb. 5, 1980 [JP] Japan ..... 55-12593

[51] Int. Cl.[3] ..... B65B 1/34

[52] U.S. Cl. ..... 53/426; 53/468; 53/471; 141/10

[58] Field of Search ..... 53/50, 109, 273, 381 A, 53/403, 407, 426, 468, 471; 141/502, 83, 90, 91, 114, 128, 317, 10; 177/118

[56] References Cited

U.S. PATENT DOCUMENTS

| | | | |
|---|---|---|---|
| 676,100 | 6/1901 | Smith | 177/118 |
| 2,017,766 | 10/1935 | Mullen | 53/109 X |
| 2,337,170 | 12/1943 | Wareham | 53/109 X |
| 3,254,683 | 6/1966 | Jennings | 141/128 |
| 3,299,606 | 1/1967 | Weikbert | 53/468 X |
| 3,359,062 | 12/1967 | Palm | 141/90 X |
| 3,377,775 | 4/1968 | Mattimoe | 53/381 A |
| 3,403,826 | 10/1968 | Buford | 141/114 X |
| 3,430,639 | 3/1969 | Roberts | 141/91 X |
| 3,447,281 | 6/1969 | Buford | 3/381 A |
| 3,491,803 | 1/1970 | Galik | 141/114 |
| 3,595,281 | 7/1971 | Laub | 141/128 X |
| 3,765,142 | 10/1973 | Lindquist | 53/407 |
| 4,024,896 | 5/1977 | Ishioka | 141/90 |
| 4,077,182 | 3/1978 | Popalvca | 53/381 A X |
| 4,120,134 | 10/1978 | Scholle | 141/114 X |
| 4,300,600 | 11/1981 | Tetenborg | 141/10 |

FOREIGN PATENT DOCUMENTS

| | | | |
|---|---|---|---|
| 53-2395 | 1/1978 | Japan | 53/381 A |

*Primary Examiner*—John Sipos

*Attorney, Agent, or Firm*—Parkhurst & Oliff

[57] ABSTRACT

For filling successive spouted bags with a beverage or like fluid product to a prescribed weight, a filling valve assembly and a cap remover assembly are immovably mounted side by side in a germfree chamber formed over a weighing platform. After the germfree chamber and the interior of a filling head forming a part of the filling valve assembly have been sterilized, a bag is placed on or over the weighing platform, with its capped spout caught by a spout carrier arm, which is supported on the weighing platform for both linear up-and-down motion and pivotal motion about a vertical axis. Following the removal of the cap from the spout by the cap remover assembly, the arm carries the spout to a position under the filling valve assembly and holds the spout against the filling head. The fluid is first charged into the bag at a high rate to an extent slightly less than the prescribed weight and then, with the spout separated and held at a slight distance from the filling head, at a reduced rate to the prescribed weight as ascertained by the weighing platform. Sterilized air under pressure is introduced into the germfree chamber throughout the progress of the filling operation to maintain the chamber at a higher-than-atmospheric pressure.

13 Claims, 12 Drawing Figures

CONTAMINATION-FREE METHOD AND APPARATUS FOR FILLING SPOUTED BAGS WITH A FLUID

This is a division of application Ser. No. 230,705 filed Feb. 2, 1981.

BACKGROUND OF THE INVENTION

This invention relates generally to machine filling of fluid materials into packages and particularly to a method of, and apparatus for, filling beverages or other fluid products to a predetermined weight into spouted bags in a manner well calculated to avoid microbial contamination and spoilage of the products.

A filling machine bearing particular pertinence to the present invention is described and claimed in Japanese Patent Publication No. 53-2395 (2395/1978) filed by the assignee of the instant application. Intended to fill spouted bags with a fluid food, this prior art machine comprises a collet assembly and a filling nozzle assembly mounted side by side on a swing arm in a germfree chamber. The swing arm is pivotable about a vertical axis for alternately moving the two assemblies to a position of registry with a bottom opening of the germfree chamber, besides being linearly movable up and down.

For filling a bag by this conventional machine the bag is placed on a weighing platform under the germfree chamber, with its capped spout caught by a fixed spout holder at the bottom opening of the chamber. The cap is first removed from the spout by the collet assembly. Then, with the filling nozzle assembly moved to the working position by the swing arm, the fluid is introduced into the bag to the prescribed weight as detected by the weighing machine including the platform. Thereafter the collet assembly is again moved to the working position to close the spout of the filled bag with the cap. Throughout the progress of this filling operation, filtered, heated air is continuously pumped into the chamber to maintain the same germfree.

Although well calculated to accomplish the purposes for which it is intended, this prior art filling machine has proved to have some drawbacks. First, since the spout of the bag is held in contact with the filling nozzle assembly while the fluid is being charged therein, it is difficult to accurately weigh the contained fluid. The precise weighing of the contained fluid is almost impossible in cases where the bag itself is housed in a carton or box.

Another drawback arises from the fact that the spout of the bag being filled is supported by the fixed spout holder. This member must lie as far inside the germfree chamber as possible in order to protect the open spout from contamination during the filling operation, making it difficult to manipulate the spout into and out of engagement with the spout holder.

The fixed spout holder gives rise to additional difficulties in making the chamber germfree prior to the commencement of successive cycles of the filling operation. The known filling machine sterilizes the chamber with high temperature steam introduced through the filling nozzle assembly. Owing to the presence of the fixed spout holder at its bottom opening, however, the chamber cannot be hermetically closed, so that it is difficult to raise the temperature of the steam under atmospheric pressure about 100° C. Steam at temperatures not exceeding 100° C. is unable to destroy some microorganisms that are highly resistant to heat. The complete sterilization of the chamber is made even more difficult because of the presence therein of the mechanisms for moving the collet assembly and the filling nozzle assembly to and away from the working position over the fixed spout holder.

A similar problem has been encountered with the steam sterilization of the inteior of the filling nozzle. As steam is passed through the filling nozzle under atmospheric pressure, as has been the case heretofore, its temperature does not rise beyond 100° C. and so is insufficient to kill heat-resistant bacteria.

A further objection to the conventional filling machine also concerns its filling nozzle. Since this nozzle has a piston or valve member slidably mounted therein, metal particles created by abrasion, lubricant, and like contaminants may find their way into the food being dispensed therefrom. Still further, the nozzle assembly, which is of considerable axial dimension, has not been designed for ease of disassemblage and cleaning.

SUMMARY OF THE INVENTION

The present invention seeks to overcome all of the listed problems of the prior art and to provide an improved method of, and apparatus for, filling a fluid product exactly to a prescribed weight into each of successive spouted bags. The invention also seeks to eliminate the difficulties heretofore encountered in avoiding the contamination of the fluid product with microorganisms and other foreign matter during its filling operation.

A brief study of the apparatus, rather than the method, according to the present invention will lead to an easier understanding of the invention. The apparatus comprises a filling valve assembly and a cap remover assembly mounted side by side and in fixed positions in a germfree chamber over a weighing platform. Supported on the weighing platform for engagement with the spout of each bag, a spout carrier is moved both vertically and horizontally by means also mounted on the weighing platform. The apparatus further comprises means for sterilizing the germfree chamber, means for sterilizing the interior of a filling head forming a part of the filling valve assembly, and means for continuously introducing sterilized air under pressure into the chamber in order to maintain the same germfree during the filling operation.

In operation, and in accordance with the method of this invention, the germfree chamber and the interior of the filling head are sterilized prior to successive cycles of filling operation. The spout of a bag to be filled is first held by the movable spout carrier in a first position on the weighing platform, and a cap is removed from the spout by the cap remover assembly. Subsequently carried to a second position on the weighing platform by the spout carrier, the open spout of the bag is held against the filling head to receive the fluid product therefrom, but to an extent less than the prescribed weight of the fluid to be filled into each bag. Then, with the spout separated and held at a slight distance from the filling head, the fluid is further charged into the bag, preferably at a reduced rate, to the prescribed weight as detected by the weighing platform. The spout carrier carries the spout of the filled bag back to the first position, where the cap remover assembly recloses the spout with the cap.

It will have been seen that the invention permits accurate measurement of the gross weight of each bag and the contained fluid by the weighing platform. This is firstly because the spout of the bag is held out of contact with the filling head toward the end of filling operation and, secondly, because the spout carrier and its drive mechanisms are all mounted on the weighing platform.

Another advantage is that since the spout carrier is movable up and down, the housing defining the germfree chamber can have its bottom opening hermetically closed. For this reason the chamber can be effectively sterilized, as with high temperature steam or sprays of a sterilizing agent such as a hydrogen peroxide solution. The sterility of the chamber can be all the more enhanced because it accommodates only the filling valve assembly and the cap remover assembly.

For sterilizing the interior of the filling head, on the other hand, steam is passed therethrough under increased pressure. The pressurized steam will attain temperatures above 100° C. and so will destroy even heat-resistant bacteria.

According to a further structural feature of this invention, a bellows is sleeved upon the stem of a valve member mounted in the filling head in order to prevent metal particles, lubricant and like contaminants from mingling with the fluid product to be dispensed therefrom. Still further, the filling head and the valve member are made readily detachable from the valve actuator, another component of the filling valve assembly, for ease of cleaning.

The features which are believed to be characteristic of this invention are set forth in the appended claims. The invention itself, however, both as to its organization and method of operation, will best be understood from the following detailed description taken in connection with the attached drawings.

DETAILED DESCRIPTION OF THE INVENTION

Figure 1:
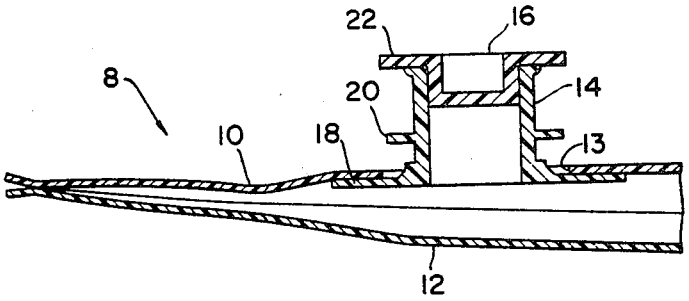
FIG. 1 is a fragmentary sectional view of one example of a spouted bag suitable for use with the present invention.

The method and apparatus of this invention presuppose the use of a spouted bag such as the one shown in FIG. 1. Generally designated 8, the example bag is made of two films 10 and 12 of pliant material sealed together along their marginal edges. The upper film 10 has a hole 13 in which there is mounted a spout 14 having a flange 18 at its bottom end and another flange 20 intermediate its opposite ends. The spout 14 is affixed to the bag 8 by having its bottom flange 18 heat-sealed to the inside surface of the upper film 10. A cap 16 having a flange 22 closes the spout 14. It is assumed that the spouted bag 8 has its interior sterilized before being filled with a desired fluid material.

Figure 2:
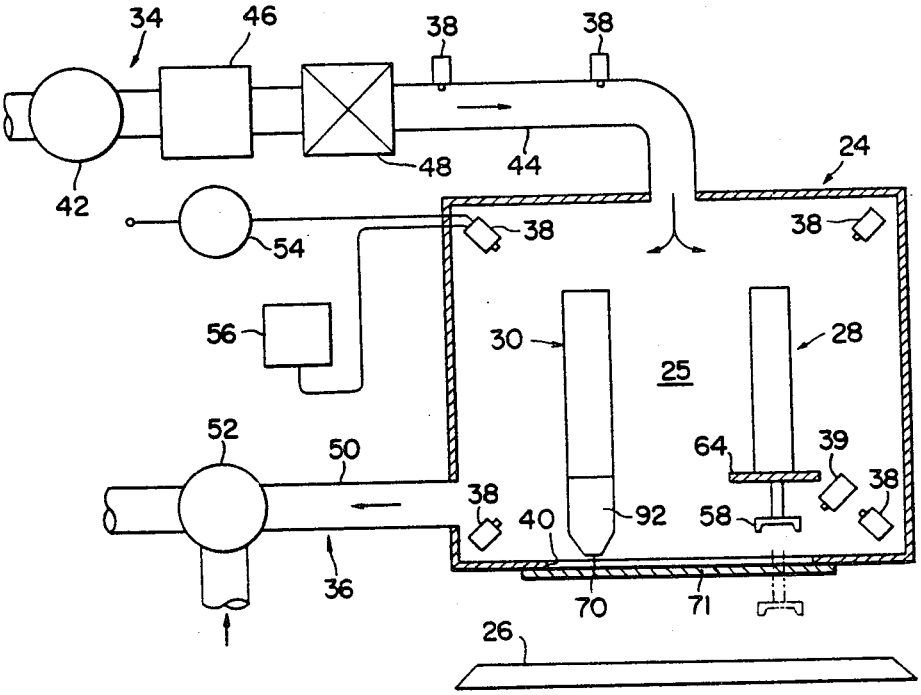
FIG. 2 is a diagrammatic representation of a preferred form of the apparatus according to the invention.

FIG. 2 is a diagrammatic representation of the apparatus for filling a beverage or like fluid material into the spouted bag 8 in accordance with the invention, the apparatus being shown in its more practical form in FIGS. 3 through 8. FIG. 2 is intended merely to illustrate and explain the general organization of the apparatus.

In broad outline the apparatus comprises a housing 24 defining a germfree chamber 25 over a weighing platform 26, and a cap remover assembly 28 and two-way filling valve assembly 30 juxtaposed in the germfree chamber. Although not seen in FIG. 2, another important component of the apparatus is a spout carrier arm, shown at 32 in FIGS. 3, 4 and 5, which is movable both vertically and horizontally for carrying the spout 14 of the bag 8 between the cap remover assembly 28 and the two-way filling valve assembly 30.

Immovably supported by the frame, not shown, of the apparatus, the housing 24 is generally box-shaped and has an opening 40 formed in its bottom. This bottom opening can be hermetically closed with a removable door 71. The housing 24 is provided with means 34 for the introduction of heated, sterilized air into the germfree chamber 25, means 36 for exhausting the chamber, and a suitable number of spray nozzles 38 for spraying a sterilizing liquid, such as an aqueous solution of hydrogen peroxide, into the chamber.

The means 34 for the delivery of heated, sterilized air into the germfree chamber 25 comprise a blower 42, a heater 46, and a filter 48, all mounted on a conduit system 44 open to the germfree chamber at its top. Preferably, and as shown, the conduit system 44 should be equipped with spray nozzles 38, similar to those within the germfree chamber 25, for sterilizing its interior downstream of the filter 48.

The exhaust means 36 include a conduit 50 communicatively coupled to the housing 24 at a point considerably distanced from the open end of the conduit system 44. The conduit 50 opens to the atmosphere via an exhaust blower 52 or, alternatively, leads to a suitable device for the recovery of useful substances from the exhaust.

Disposed at the corners of the germfree chamber 25, the spray nozzles 38 are of the two-fluid design, producing a spray of the hydrogen peroxide solution from a reservoir 56 under the pressure of air that has passed a filter 54. A recommended concentration of hydrogen peroxide in the solution is approximately 35%. Each spray nozzle could, of course, be of the one-fluid type. As a further alternative, an ultrasonic mist generator may be mounted on the reservoir 56, and the mist of the hydrogen peroxide solution may be carried by air into the germfree chamber. In this case the nozzles within the chamber need not have a spraying function.

The weighing platform 26 underlies the housing 24, in a position opposed to its bottom opening 40, and with a suitable spacing therebetween for mounting the spouted bag 8 on the platform for filling operation. The weighing platform forms a part of a weighing machine of any known or suitable type. Although not illustrated, the weighing machine may include levers coupled to the platform and proximity switches responsive to the displacement of the levers, generating an electrical signal representative of the weight of the load on the platform 26.

As will be understood from a study of FIGS. 3 and 4, the cap remover assembly 28 comprises a fluid actuated cylinder 62 (hereinafter referred to as the cap remover cylinder), having a piston rod 60 extending downwardly therefrom, and a socket 58 rigidly coupled to the bottom end of the piston rod. The cap remover cylinder 62 is erected on a mount 64 in the shape of an inverted U standing on the bottom of the housing 24 so as to span its bottom opening 40. Thus, with the extension and contraction of the cap remover cylinder 62, the socket 58 moves out of, and back into, the germfree chamber 25 through the opening 40. In so doing the socket 58 coacts with the spout carrier arm 32 to remove the cap 16 from, and replace the same on, the spout 14 of the bag 8 on the weighing platform 26, as will become better understood as the description progresses.

Figure 6A:
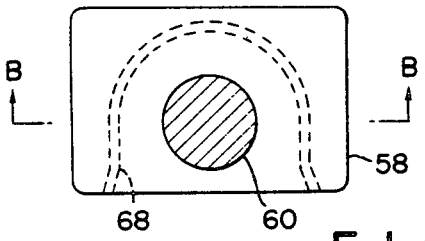
FIG. 6A is an enlarged plan view of a socket member of the cap remover assembly in the apparatus.
Figure 6B:
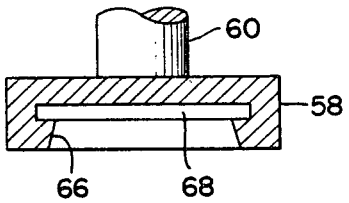
FIG. 6B is a section taken along the line B—B of FIG. 6A as viewed in the arrow direction.

FIGS. 6A and 6B illustrate the details of the socket 58 on an enlarged scale. This member takes the form of a relatively thick, rectangular plate, affixed horizontally to the piston rod 60. The socket has a substantially semicircular depression 66, opening both downwardly and laterally, which is enlarged at 68. Consequently, as the operator manipulates the flange 22 of the cap on the spout of the bag into the enlargement 68 of the depression 66, the socket 58 positively holds the cap against the possibility of its dislodgement in the donwward direction.

Figure 3:
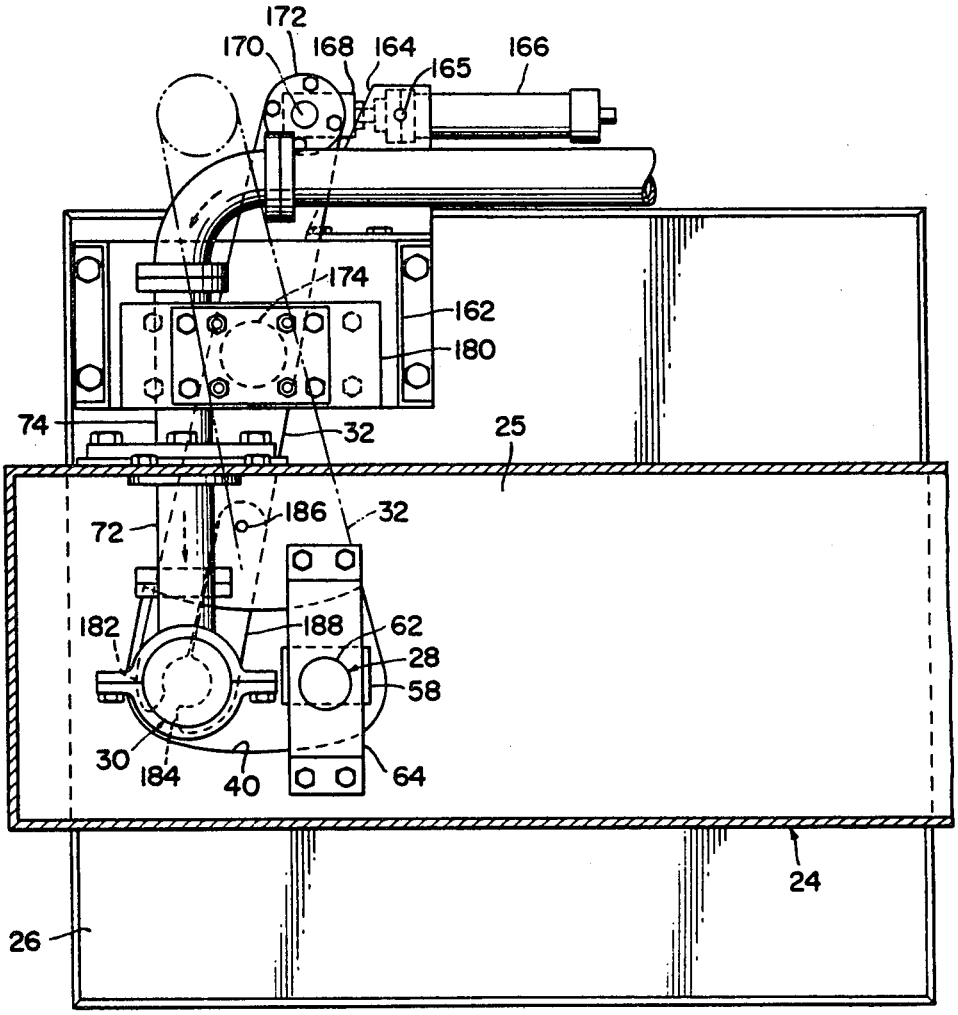
FIG. 3 is a horizontal sectional view of the apparatus constructed in accordance with the concepts of FIG. 2.
Figure 4:
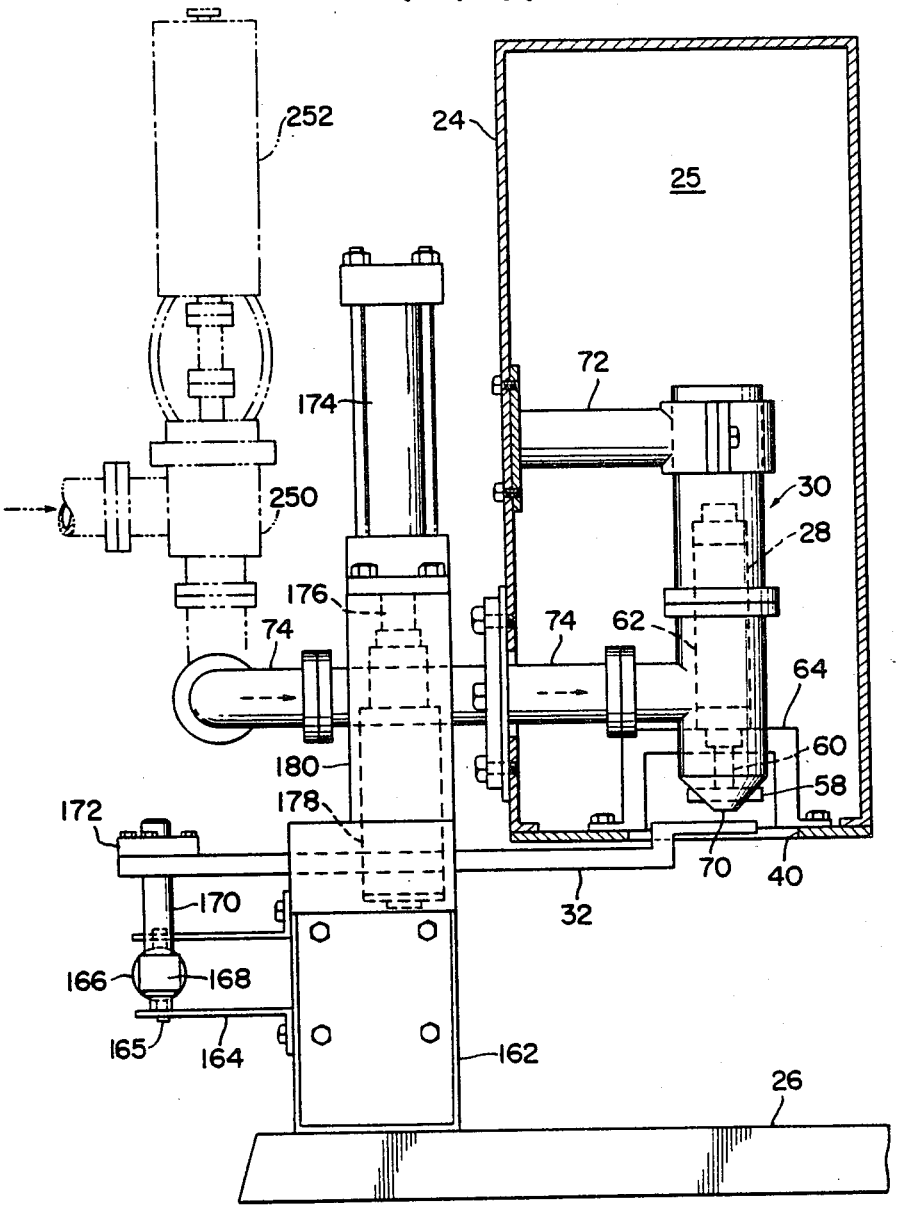
FIG. 4 is a vertical sectional view of the apparatus of FIG. 3.
Figure 7:
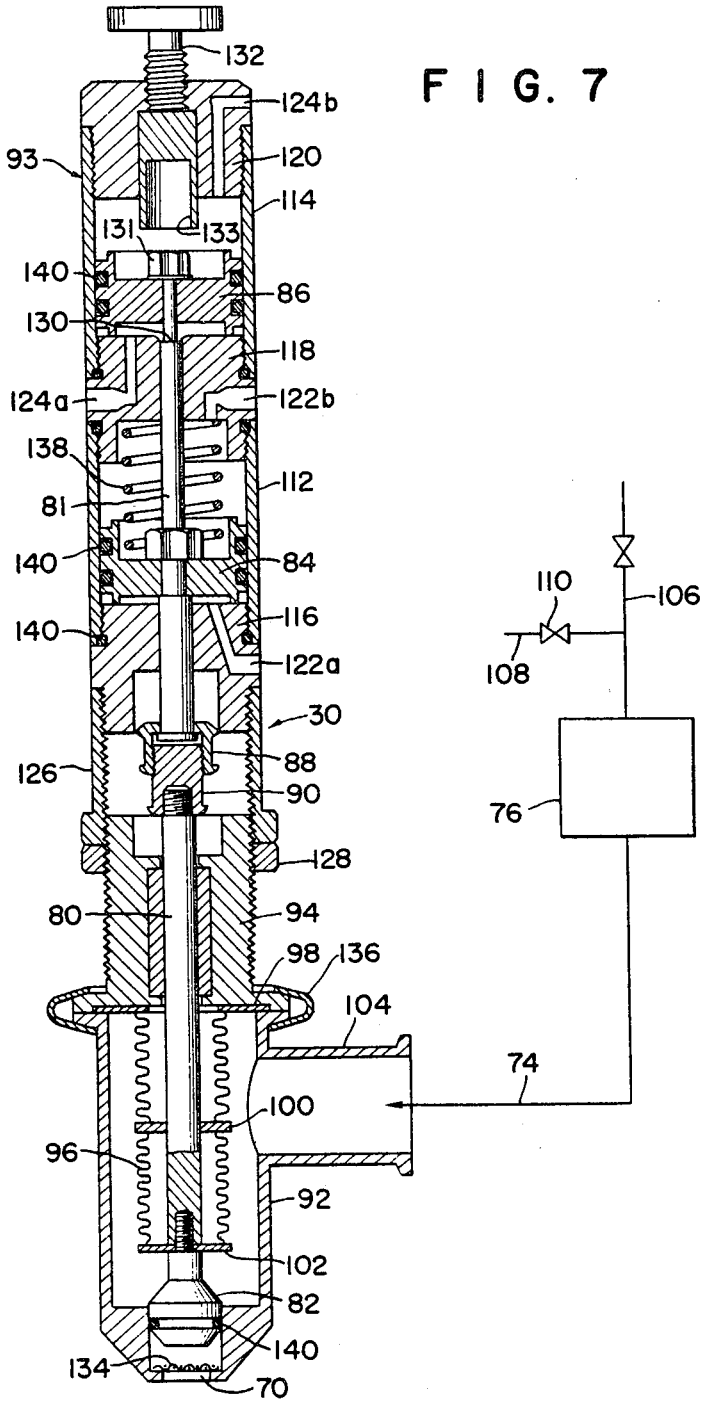
FIG. 7 is an enlarged axial sectional view of the filling valve assembly in the apparatus.

As shown in FIGS. 3 and 4 and in greater detail in FIG. 7, the two-way filling valve assembly 30 is also mounted in the germfree chamber 25 in side-by-side relation with the cap remover assembly 28 and just over the bottom opening 40. It will be noted from FIG. 4 that the filling valve assembly 30 is supported uprightly by an arm 72 secured to the rear wall of the housing 24. This figure also shows a conduit system 74 for the delivery of a beverage or like fluid product into the filling valve assembly, thereby to be filled in the bag 8.

Reference is now directed specifically to FIG. 7 for an inspection of the detailed configuration of the filling valve assembly 30. Essentially this assembly is made up of a filling head 92 having a valve 82 for controlling the flow rate of the fluid material through its dispensing opening 70, and a dual piston actuator 93 for the controlled actuation of the valve 82. The tip of the filling head 92 lies slightly above the level of the bottom opening 40 of the housing for minimal contact with external air.

A mesh filter 134 is fitted in the dispensing opening 70 of the filling head 92. The valve 82 has a stem 80 extending axially of the filling head and further slidably through a cap or sleeve 94 closing the top end of the filling head 92. The cap 94 makes a pressure-tight flange union with the filling head 92 with the aid of a clamp 136. Threaded externally, moreover, the cap 94 serves to connect the filling head with the dual piston actuator 93 in a readily removable manner, as will be later explained in further detail.

Within the filling head 92, a cylindrical bellows 96 loosely encircles the valve stem 80. The bellows is supported by three flanges 98, 100 and 102 in axially spaced positions on the valve stem. The upper flange 98 is caught between the flanges of the filling head 92 and its cap 94; the middle flange 100 is pressfitted over the valve stem 80; and the lower flange 102 is caught between the valve 82 and its stem. Thus the bellows 96 is fluid-tightly secured at one end to the cap 94, forming the upper end of the filling head 92, and at the other end to the valve stem 80. Consequently, even though lubricant and metal particles created by abrasion may intrude into the filling head 92 past the mating surfaces of the valve stem 80 and the cap 94, the bellows 96 functions to prevent such contaminants from mingling with the fluid material to be filled into the bag, without in any way hampering the axial motion of the valve stem.

The filling head 92 has a fluid inlet 104 for receiving the fluid protect from a surge tank 76 by way of the conduit system 74. This conduit system is assumed to have a flowmeter, a pump, etc., which are not illustrated because of their conventional nature. The surge tank 76 itself receives the fluid from a suitable sterilizer, also not shown, by way of a conduit 106. Another conduit 108 coupled to the conduit 106 via a valve 110 is intended for the supply of steam at high temperatures.

The dual piston actuator 93 of the two-way filling valve assembly 30 comprises a piston rod 81 in coaxial alignment with the valve stem 80, a first piston 84 slidably fitted in a first cylinder 112 and fixedly mounted on the piston rod, a second piston 86 slidably fitted in a second cylinder 114 and mounted on the piston rod for sliding motion within limits, and a return spring 138 acting on the first piston for normally holding the dispensing opening 70 of the filling head 92 closed by the valve 82.

Slidably extending through and projecting downwardly from a cap 116 closing the bottom end of the first cylinder 112, the piston rod 81 has a tapped collar coupling member 88 on its bottom end for threaded engagement with a male coupling member 90 screwed onto the top end of the valve stem 80. The piston rod and the valve stem can therefore be readily connected and disconnected by turning the coupling members 88 and 90 relative to each other. These coupling members are located inside a connecting nut 126 which is in threaded engagement with both the cap 94 of the filling head 92 and the cap 116 of the dual piston actuator 93 for interconnecting them in coaxial alignment. A locknut 128 on the cap 94 serves to restrain this cap from unnecessary angular displacement relative to the connecting nut 126.

It is thus seen that the filling head 92, as well as the valve 82 with its stem 80 mounted therein, can be readily removed from the dual piston actuator 93. Such easy removal of the filling head is preferred because its interior should be cleaned periodically in order to avoid development of bacteria or the like.

The dual piston actuator 93 further comprises a sleeve or partition 118 slidably fitted over the piston rod 81 and rigidly interconnecting the two cylinders 112 and 114 and a cap 12 closing the top end of the second cylinder 114. The cap 116 and sleeve 118 closing the opposite ends of the first cylinder 112 have ports **122*a* and 122*b* formed therein for the ingress and egress of a fluid, normally air, under pressure into and out of the opposed fluid chambers of the first cylinder. The sleeve 118 and cap 120 closing the opposite ends of the second cylinder 114 also have ports 124*a* and 124*b*** formed therein for the ingress and egress of pressurized air into and out of the opposed fluid chambers of the second cylinder.

As has been stated, while the first piston 84 is anchored against axial displacement on the piston rod 81, the second piston 86 is slidable on the piston rod within limits. These limits are set by a shoulder 130 of the piston rod and a locknut 131 on its top end. The end cap 120 of the second cylinder 114 has an adjustable stop 132 mounted therein for limiting the upward stroke of the second piston 86. This adjustable stop is bored at 133 for receiving the locknut 131 with clearance.

It will now be clear that the stroke of the first piston 84 is longer than that of the second piston 86. Consequently, upon delivery of pressurized air into the first cylinder 112 through its port 122*a*, the valve 82 opens the dispensing opening 70 of the filling head 92 to a greater extend than when such air is introduced into the second cylinder 114 through its port 124*a*. The first cylinder 112 is therefore intended to actuate the valve 82 when the bag is to be filled at a high rate, and the second cylinder 114 to actuate the valve when the bag is to be filled at a reduced rate. The fluid delivery at the high rate is carried out for what is herein termed the "bulk filling" of the bag, and that at the reduced rate for "makeup filling", as will be explained in more detail in a subsequent description of the operation.

The various joints of the dual piston actuator 93 must be sealed against high pressures that may develop in operation. Shown at parts 140 are O rings used for this purpose.

Figure 5:
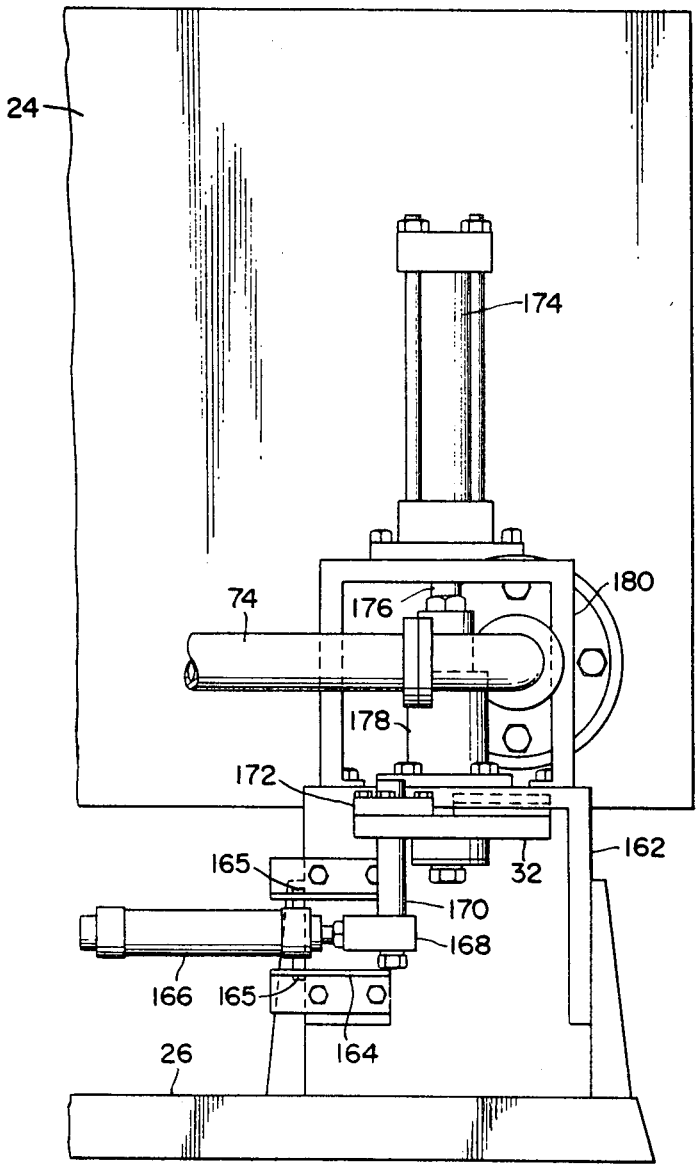
FIG. 5 is a rear elevational view of the apparatus.

FIGS. 3, 4 and 5 illustrate the aforesaid spout carrier arm 32 and the provisions for actuating the arm both horizontally and vertically. The spout carrier arm 32 is disposed horizontally just under the housing 24, with its free end opposed to the bottom opening 40 of the housing. The means for the activation of this arm include two fluid actuated cylinders 166 and 174. The cylinder 166 functions to swing the spout carrier arm in a horizontal plane and so will be hereinafter referred to as the swing cylinder. The other cylinder 174 acts to move the spout carrier arm up and down and so will be hereinafter called the lift cylinder.

The swing cylinder 166 is supported by a pair of brackets 164 via trunnions 165 for pivotal motion about a vertical axis. The brackets 164 are fastened to a standard 162 mounted on the weighin platform 26. It should be noted that the spout carrier arm 32 as well as its complete supporting and actuating mechanisms is mounted on the weighing platform 26. This is necessary for accurately weighing the fluid product charged into the bag on the platform, since the spout carrier arm 32 holds the spout of the bag during the filling operation.

The piston rod of the swing cylinder 166 is connected via a coupling member 168 to a connecting rod 170 extending upwardly therefrom. The connecting rod 170 has a stop 172 fixedly mounted on its top end. The spout carrier arm 32 is bored at its rear end and fitted over the connecting rod 170 for sliding motion in its axial direction.

The lift cylinder 174 is supported vertically on a mount 180 placed on top of the standard 162. Extending downwardly from this lift cylinder, its piston rod 176 is coupled to the spout carrier arm 32, at a point intermediate its ends, via a thrust bearing 178 so as to permit the pivotal motion of the spout carrier arm in a horizontal plane. Thus, the spout carrier arm 32 is both pivoted about the vertical axis of the piston rod 176 by the swing cylinder 166 and moved up and down by the lift cylinder 174, with its rear end sliding over and along the connecting rod 170.

The pivotal motion of the spout carrier arm 32 caused by the swing cylinder 166 takes place between the solid-line and phantom positions depicted in FIG. 3. The shape and size of the bottom opening 40 in the housing 24, and the positions of the cap remover assembly 28 and the two-way filling valve assembly 30, are determined in relation to the above two working positions of the spout carrier arm 32.

For engaging the spout 14 of the bag 8 shown in FIG. 1, the spout carrier arm 32 has its free end formed into a pair of gripping fingers comprising a fixed one 182 and a movable one 184 as in FIG. 3. The movable finger 184 is a part of a lever 188 pivotable horizontally about a pin 186. Shaped as opposed arcs, the two gripping fingers 182 and 184 coact to grip the spout 14 of the bag while being themselves caught between the two flanges 18 and 20 of the spout.

In the first or phantom position in FIG. 3 the spout carrier arm 32 holds the spout of the bag under the cap remover assembly 28 for opening and closing the spout. In the second or solid-line position, on the other hand, the spout carrier arm holds the open spout of the bag under the two-way filling valve assembly 30, permitting the latter to charge the fluid into the bag in the "bulk filling" and "makeup filling" modes.

As will be noted from FIG. 3, the housing 24 defining the germfree chamber 25 can be elongated horizontally to accommodate an additional set or sets of cap remover assemblies and two-way filling valve assemblies. Further, by providing a spout carrier arm and a weighing platform for each set of such assemblies, two or more bags can be filled at one time.

Figure 8:
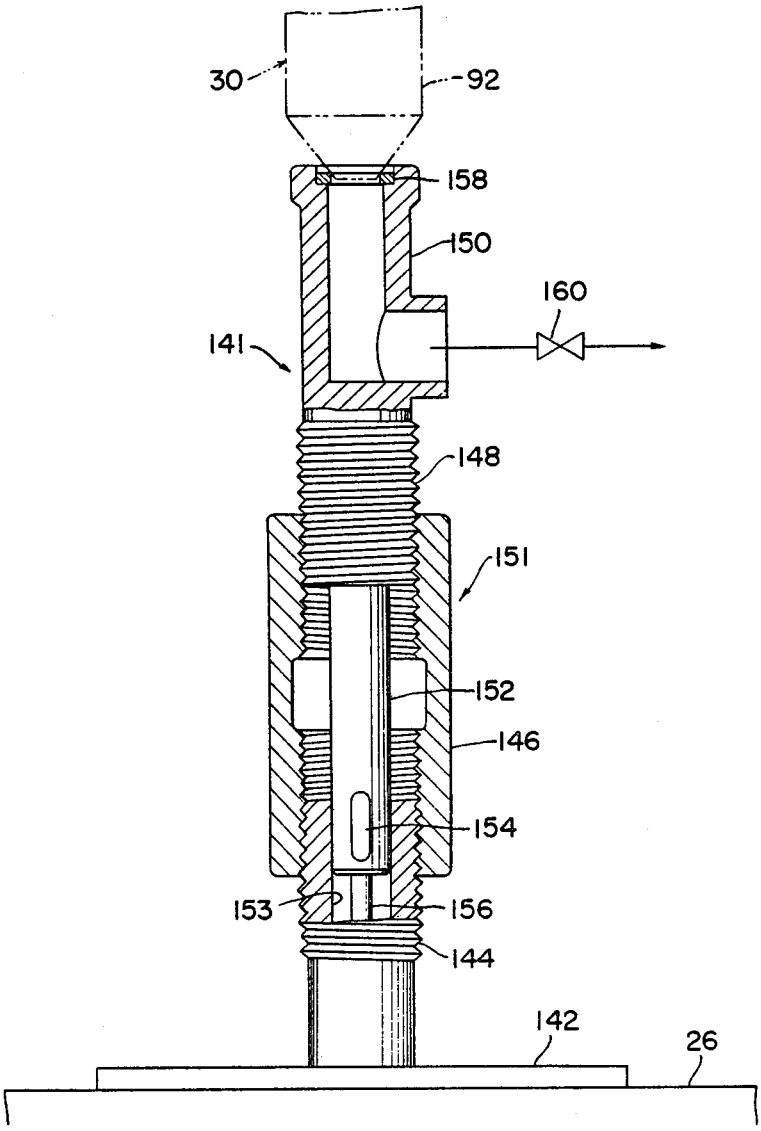
FIG. 8 is an axial sectional view, partly in elevation, of an exhaust assembly for use in the steam sterilization of the filling head in the apparatus.

Shown in FIG. 8 and generally labeled 141 is an exhaust assembly for use in sterilizing the interior of the filling head 92 with high temperature steam, preparatory to the filling of successive bags with the desired fluid product. In essence, the exhaust assembly 141 is an integral combination of an exhaust elbow 150 and a turnbuckle 151. The turnbuckle serves to hold the exhaust elbow pressure-tightly against the filling head, as through a gasket 158.

The turnbuckle 151 of the exhaust assembly comprises two rods 144 and 148 having external screw threads of opposite hands, and a tapped sleeve 146 engaged with both threaded rods. A pin 152 is rigidly coupled at its top end to the upper threaded rod 148 and at its bottom end is fitted in a bore 153 in the lower threaded rod 144 for sliding motion in its axial direction. Keys 154 on the pin 152 are slidably engaged in keyways 156 in the lower threaded rod 144. Thus the pin 152 functions to restrain the two threaded rods 144 and 148 from relative angular displacement and to constrain them to movement toward and away from each other as a result of revolution of the sleeve 146. A pedestal 142 integral with the lower threaded rod 144 supports the exhaust assembly 141 uprightly on the weighing platform 26.

During the sterilization of the filling head 92 with the use of the exhaust assembly 141, the steam will attain a higher temperature and more effectively destroy the microbial life within the filling head if its pressure is increased. For attainment of this objective, a pressure control valve 160 is placed in communication with the outlet of the exhaust elbow 150. This pressure control valve acts, of course, to restrict the exhaust passageway of the sterilizing steam and hence to increase the internal pressure of the filling head.

The following is a description of the operation of the apparatus constructed as set forth hereinabove. The method of this invention will also become apparent from such description.

Prior to the commencement of the filling operation, the interior of the filling head 92 and the germfree chamber 25 must be sterilized to preclude the possibility of contamination of the fluid product with bacteria and other microorganisms. First, for the sterilization of the filling head 92, the exhaust assembly 141 of FIG. 8 is placed thereunder, with its pedestal 142 held against the weighing platform 26. The sleeve 146 of its turnbuckle 151 is then turned in such a direction that the two threaded rods 144 and 148 move apart from each other until the exhaust elbow 150 makes pressure-tight contact with the filling head 92.

Then air under pressure is introduced into the first cylinder 112 of the filling valve assembly 30, FIG. 7, thereby causing upward displacement of the first piston 84 together with the valve member 82 to open the filling head 92. Then the valve 110 in the conduit 108 shown in the same figure is opened to direct high-temperature steam into the filling head 92 by way of the surge tank 76 and the conduit 74. After filling the interior of the filling head 92, exclusive of the space within the bellows 96, the steam flows out of its dispensing opening 70 to be exhausted through the exhaust elbow 150.

Since the pressure control valve 160 restricts the exhaust passageway of the steam as aforesaid, the internal pressure of the filling head 92 rises to elevate the temperature of the steam. The steam at such elevated temperatures will kill all the microorganisms within the filling head, including those highly resistive to heat.

Upon completion of the sterilization of the filling head 92, the valve 110 is closed to terminate the delivery of steam, and the introduction of pressurized air into the first cylinder 112 is also suspended to allow the valve member 82 to close the dispensing opening 70 under the bias of the return spring 138. Then the sleeve 146 of the exhaust assembly 141, FIG. 8, is turned in a direction to disengage the exhaust elbow 150 from the filling head 92. The exhaust assembly is subsequently withdrawn from over the weighing platform 26.

It should be appreciated that the use of the exhaust assembly 141 with the turnbuckle 151 makes it unnecessary to form a screw thread on the filling head 92 for threaded engagement with the exhaust elbow 150 or with its equivalent, as has been the case heretofore. The provision of such a thread on the filling head is objectionable because the fluid material ejected therefrom readily adheres to and accumulates on the threaded portion, creating a source of contamination.

Next comes the step of sterilizing the germfree chamber 25, by the means shown in FIG. 2. First, with the door 71 removed, the blower 42 and heater 46 are both operated to introduce heated, filtered air into the chamber 25 thereby heating the same to a temperature of approximately 90° C. Then the blower 42 is stopped and the bottom opening 40 of the housing 24 is closed with the door 71.

Then a 35% hydrogen peroxide solution is sprayed into the chamber 25 from the nozzles 38, thereby filling the chamber with the droplets of the solution. The preliminary heating of the chamber serves the dual purpose of enhancing the sterilizing effectiveness of the hydrogen peroxide solution, making possible the complete destruction of microorganisms within the chamber, and of accelerating the vaporization of the sprayed liquid.

Following the chemical sterilization of the chamber, the blower 42 is again started, this time together with the exhaust blower 52, for the withdrawal of the droplets from the chamber and for the complete drying of the chamber. The exhaust blower 52 directs the droplets of the hydrogen peroxide solution into the unshown recovery device or, mixing them with atmospheric air, discharges into the atmosphere.

The exhaust blower 52 is stopped, and the door 71 is removed, upon completion of the drying of the chamber 25. The blower 42 and heater 46 are still operating and remain in motion as long as the filling operation of the bags proceeds thereafter, introducing heated, filtered air into the chamber to maintain the same at a higher-than-atmospheric pressure. The air constantly escapes from the chamber through its bottom opening 40, so that the space just under this opening can be thought of as being essentially part of the germfree chamber.

With the preliminary sterilization of the apparatus thus completed, the filling operation of the successive bags can now be started. It is understood that the swing cylinder 166 and lift cylinder 174 are now both extended, holding the pair of gripping fingers 182 and 184 of the spout carrier arm 32 in the position A in FIG. 9, and that the cap remover cylinder 62 is also extended to hold the socket 58 in the same position A, or just over the gripping fingers. The position A is only slightly below the bottom opening 40 of the housing 24.

Figure 9:
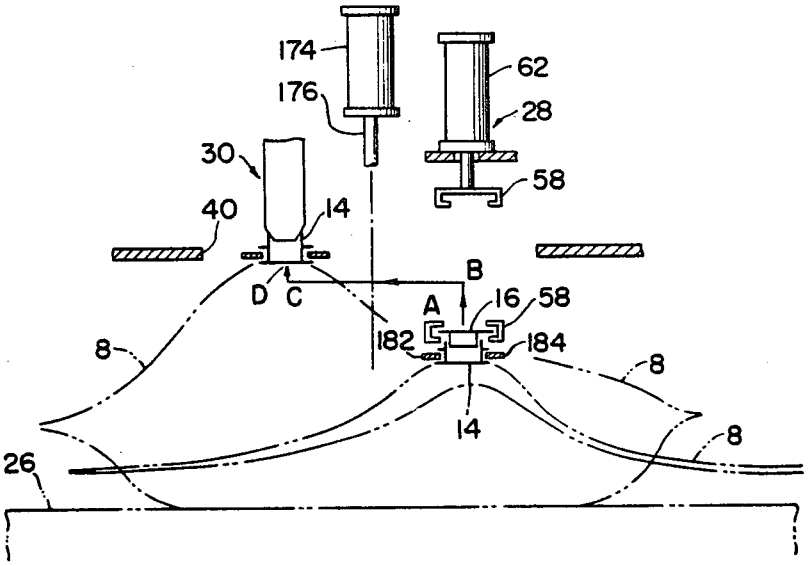
FIG. 9 is a diagram explanatory of the method of operation of the apparatus.

As will be seen also from FIG. 9, the bag 8 is placed on or held over the weighing platform 26, and its spout 14 is manually forced between the pair of gripping fingers 182 and 184 of the spout carrier arm 32, with these fingers engaged between the flanges 18 and 20 of the spout. Simultaneously the flange 22 of the cap 16 on the bag spout is fitted into the socket 58 of the cap remover assembly 28. Provision should preferably be made for locking the pair of gripping fingers together in order to preclude the possibility of accidental disengagement of the bag spout therefrom.

Then, with the cap remover cylinder 62 relieved of air pressure, the lift cylinder 174 is contracted to raise the spout carrier arm 32, together with the socket 58 thereover, to the position B which is sufficiently close to, or within, the germfree chamber 25. Since some microorganisms may have adhered to the bag spout 14 as a result of its manual handling, chlorine water is then sprayed onto the spout and the neighboring part of the bag 8 from a nozzle 39 disposed in the vicinity of the housing bottom opening 40.

Then the cap remover cylinder 62 is fully contracted to lift the socket 58 into the germfree chamber 25 and hence to remove the cap 16 from the bag spout 14. Then the swing cylinder 166 is fully contracted to turn the spout carrier arm 32 from its phantom to solid-line position in FIG. 3, so that the bag spout 14 is carried from position B to position C, immediately below the two-way filling valve assembly 30. Upon subsequent full contraction of the lift cylinder 174, the bag spout 14 rises from position C to position D to be held against the filling head 92 of the filling valve assembly.

The bag 8 is now ready to be filled with the desired fluid material. Initially, the fluid is charged in the "bulk filling" mode, so that a solenoid valve, not shown, on a conduit in communication with the lower port 122*a* of the first cylinder 112 of the two-way filling valve assembly 30 is actuated to cause upward displacement of the first piston 84 and thus to fully uncover the dispensing opening 70 of the filling head 92.

Each bag is filled to a prescribed weight, so that the fluid being charged into the bag must be measured. During the bulk filling of the bag, however, the accurate measurement of the weight of the charged fluid cannot be effected by the unshown weighing machine under the platform 26. This is because the bag spout is held against the filling head by the spout carrier arm 32 supported on the weighing platform. The bag spout is urged against the filling head under considerable pressure, moreover, in order to avoid the intrusion of external air into the bag; otherwise, bubbles would form within the bag. Therefore, instead of the weighing machine, a flowmeter or a timer associated with the noted solenoid valve for the first cylinder 112 is employed to determine the charge of the fluid to be bulk filled into the bag.

Upon completion of the bulk filling operation, the lift cylinder 174 is extended ever so slightly to lower the spout carrier arm 32. The bag spout 14 descends from position D to position C, at a minimal distance from the filling head 92. Then another solenoid valve, also not shown, for the second cylinder 114 of the two-way filling valve assembly 30 is actuated to cause upward displacement of the second piston 86 and thereby to cause the valve member 82 to slightly uncover the dispensing opening 70. Now the filling head 92 starts introducing the fluid into the bag in the "makeup filling" mode, by which is meant the filling of the bag to the prescribed weight at a reduced rate.

Since the bag spout 14 is out of contact with the filling head 92 during this makeup filling operation, and since the spout carrier arm 32 holding the spout is supported on the weighing platform 26, the weighing machine can now accurately ascertain the gross weight of the bag 8 and the fluid contained therein. When the bag has been filled to the prescribed weight, the weighing machine electrically controls the solenoid valve associated with the second cylinder 114 of the filling valve assembly 30, causing the valve 82 to close the dispensing opening 70.

Then the swing cylinder 166 is contracted to return the spout carrier arm 32 from position C to position B together with the spout 14 of the filled bag. Then the cap remover cylinder 62 is extended to reclose the spout with the cap 16. Thereafter, with the cap remover cylinder 28 again relieved of air pressure, the lift cylinder 174 is extended to lower the spout carrier arm 32 from position B to initial position A. Now the operator can unlock the pair of gripping fingers 182 and 184 of the spout carrier arm to disengage the spout 14 therefrom and can pull the cap 16 out of the socket 58.

One cycle of the filling operation is now completed. The same cycle is repeated as the operator proceeds to mount the next bag in position following the withdrawal of the filled bag from over the weighing platform 26.

Figure 10:
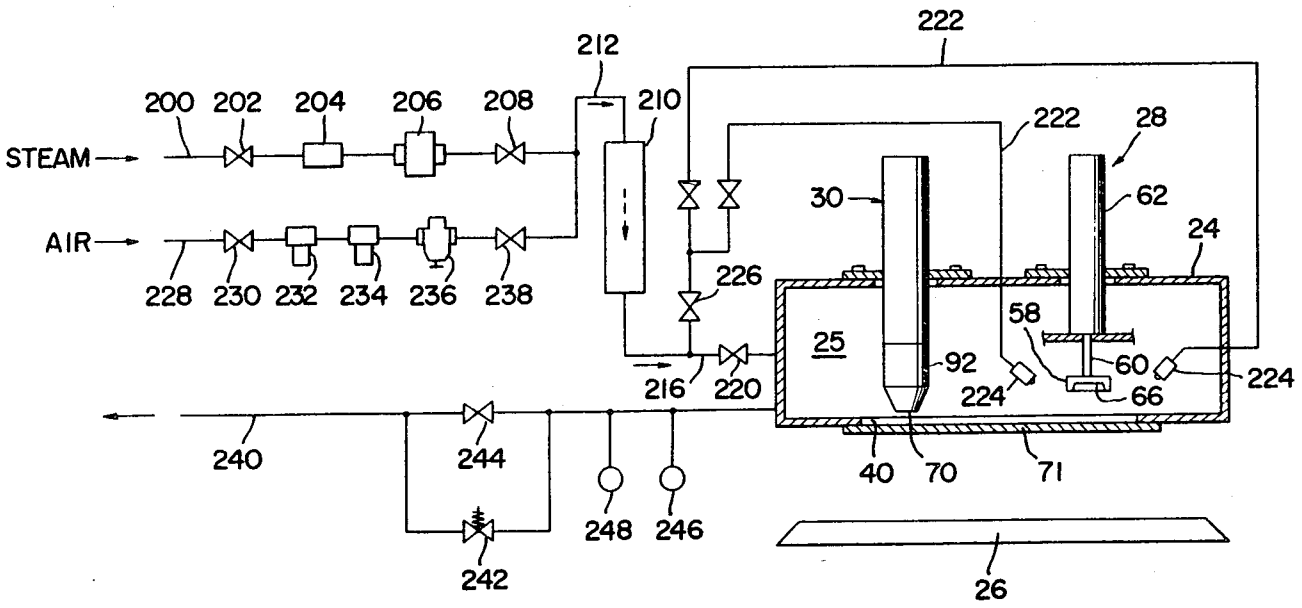
FIG. 10 is a diagrammatic representation of a slightly modified form of the apparatus according to the invention.

FIG. 10 diagrammatically illustrates an alternative form of the apparatus according to this invention, featuring modified means for making the chamber 25 germfree. This figure also shows the means for sterilizing the capped spout of each bag before it is filled. It will be noted, first of all, that the chamber 25 is reduced in size, in comparison with that shown in FIG. 2, with the cap remover assembly 28 and filling valve assembly 30 partly projecting upwardly beyond the top wall of the housing 24. The small-sized chamber is desirable in view of the higher degree of sterility attainable. The partial projection of the two assemblies 28 and 30 out of the housing 24 also offers the advantage of lessening the areas of surfaces within the housing that may be contaminated. A steam conduit 200 is provided with a ball valve 202, a strainer 204, a prefilter 206, and another ball valve 208, which are arranged in that order in the direction of steam flow through the conduit. The prefilter 206 may be a Pall Filter MCS (trade name) manufactured by Pall Trinitymicro Corporation, of the United States of America. The downstream side of the ball valve 208 communicates with a main filter 210 via a conduit 212. This main filter may take the form of a Millipore Filter (trade name) manufactured by Millipoore Limited of the United States.

The main filter 210 has an outlet conduit 216 extending into and opening to the chamber 25. The conduit 216 is provided with a ball valve 220. Branching off from the conduit 216, at a point upstream of the ball valve 220, conduits 222 communicate via a ball valve 226 with one or more, preferably two, spray nozzles 224 disposed on the opposite sides of the cap remover assembly 28 in the chamber 25. These spray nozzles are of the two-fluid type and are intended to spray chlorine water onto the spout and adjacent part of the bag to be filled.

Arranged in parallel relation with the steam conduit 200 is an air conduit 228 having a ball valve 230, a prefilter 232, a mist separator 234, a pressure reducing valve 236, and another ball valve 238, which are disposed sequentially in the direction of air flow through the conduit. The outlet of the ball valve 238 communicates with the main filter 210 by way of the conduit 212.

The chamber 25 is further provided with a conduit 240 for draining steam and its condensate therefrom. This drain conduit has a safety valve 242 and a pressure control valve 244 connected in parallel with each other. The conduit 240 has a pressure gauge 246 and a temperature gauge 248.

The arrangement of FIG. 10 permits simultaneous sterilization of the chamber 25 and the interior of the filling head 92, although the latter may be sterilized independently in the manner set forth with reference to FIGS. 7 and 8. For the simultaneous sterilization of the chamber and the filling head interior the bottom opening 40 of the housing 24 is first closed with the door 71. The pressure control valve 244 in the drain conduit 240 is slightly opened.

Then, to initiate the introduction of high temperature steam into the chamber 25, the valves 202 and 208 in the steam conduit 200 and the valve 220 on the inlet conduit 216 are all opened. (The valve 202, as well as the valve 230 in the air conduit 228, is intended to be normally held open and to be closed only when the apparatus is to be left out of operation for any extended length of time.) Traveling through the conduit 200 from its unshown source, the steam is freed from solids by the strainer 204, from finer particles by the prefilter 206, and from microbes by the main filter 210. After being thus sterilized the steam passes through the conduit 216 and the valve 220 and enters the chamber 25.

The valve 226 in the conduits 22 may also be opened as desired or required. The opening of the valve 226 at this time results in the introduction of the steam into the chamber 25 from the pair of spray nozzles 224 as well.

At the same time with such steam introduction into the chamber 25, steam is directed into the filling head 92 of the filling valve assembly 30, by opening the valve 110 on the steam conduit 108 shown in FIG. 7. The steam that has passed the filling head 92 also enters the chamber 25 through its dispensing opening 70 and is further utilized for sterilizing the chamber.

The high temperature steam may thus be delivered into the chamber 25 for approximately 30 minutes. Although the pressure control valve 244 is slightly open to permit gradual withdrawal of the steam and its condensate, the bottom opening 40 of the housing 24 is now hermetically closed, so that the steam will attain a temperature ranging from, say 120° to 130° C. Such high temperature steam can destroy all the microbial life, including heat-resistant bacteria, in the chamber 25 as well as in the filling head 92. The safety valve 242 will open as necessary to allow excess steam to escape from the chamber.

Upon completion of the simultaneous steam sterilization of the chamber 25 and the filling head 92, the valve 208 of FIG. 10 and the valve 110 of FIG. 7 are both closed to discontinue the delivery of steam into the chamber. Then the valve 238 in the air conduit 228 is opened to direct air under pressure into the chamber via the prefilter 232, mist separator 234, pressure reducing valve 236 and main filter 210. The valve 244 in the drain conduit 240 is also opened for the withdrawal of the steam and its condensate from the chamber. The door 71 is removed when the germfree chamber becomes dry and cool. Thereafter the sterilized air is continuously introduced into the chamber, throughout the progress of the filling operation, to maintain the same at positive pressure.

For spraying chlorine water onto the spout of the bag being held in the position B, FIG. 9, the liquid is fed to the pair of spray nozzles 224 from its unshown source of supply. As the valve 226 is opened to direct sterilized air under pressure to the spray nozzles 224, the chlorine water will be sprayed under the air pressure onto the spout of the bag for its sterilization or disinfection.

Figure 11:
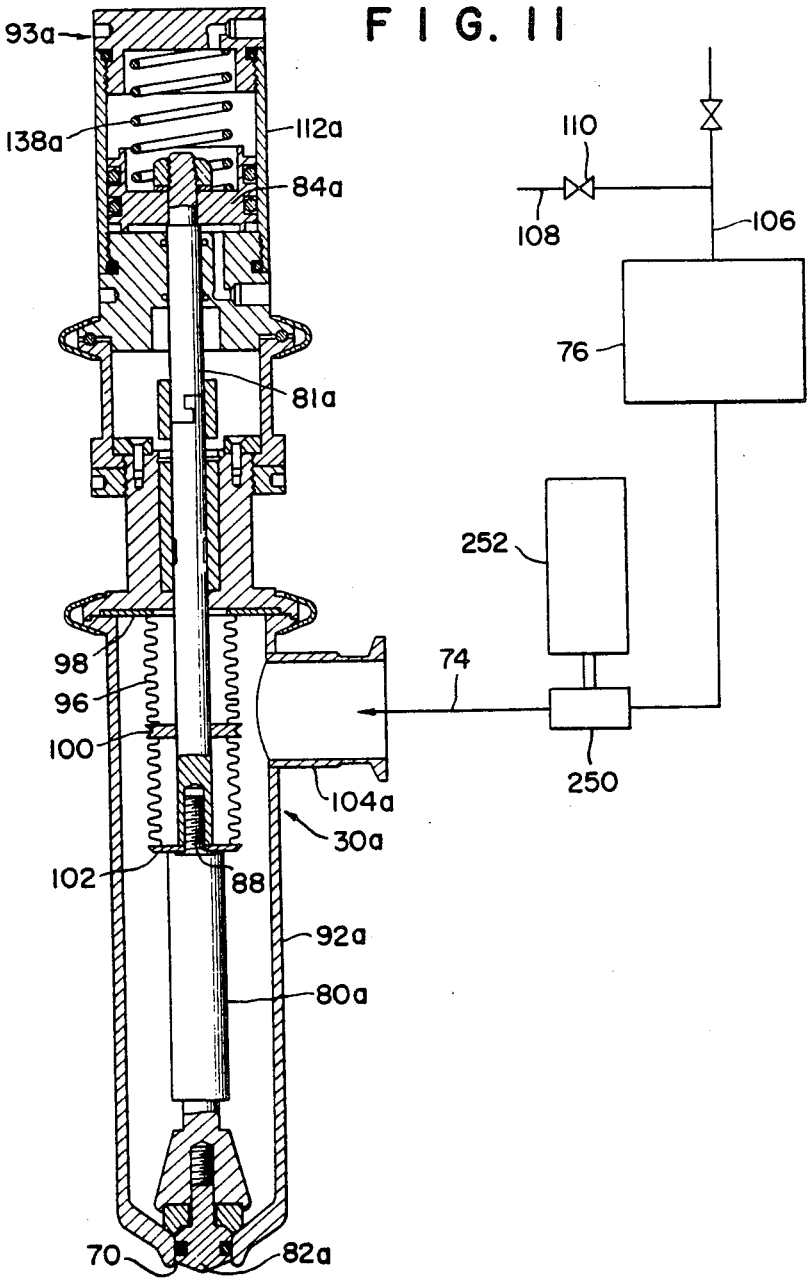
FIG. 11 is an axial sectional view of a modification of the filling valve assembly of FIG. 7.

Shown in FIG. 11 is a modified filling valve assembly 30*a*, alternative to the two-way filling valve assembly 30 of FIG. 7, as well as a three-position flow control valve 250 and its actuator 252 for controlling the flow of the fluid product from the surge tank 76 to the filling head 92*a* of the modified valve assembly.

It will be recalled that in the two-way filling valve assembly 30 of FIG. 7, the valve member 82 is shifted from a fully open to half open position at the time of transition from the bulk filling to makeup filling mode. Upon such displacement of the valve member, the fluid pressure within the filling head 92 rises abruptly, possibly resulting in the scattering of the fluid over the spout and neighboring part of the bag being filled. This can be avoided, of course, by holding the bag spout in engagement with the filling head for some time after the displacement of the valve member from the fully open to half open position. It is nevertheless preferable, in order to complete each filling operation in a shorter period of time, that the bag spout be moved out of contact with the filling head approximately at the same time as the transition from the bulk filling to makeup filling mode. The arrangement of FIG. 11 attains this objective.

The modified filling valve assembly 30*a* comprises the filling head 92*a* and a valve actuator 93*a*. The filling head is substantially identical in construction with that shown in FIG. 7. Since the valve member 82*a* of the filling head needs to move only between fully open and fully closed positions in this modified filling valve assembly, the valve actuator 93*a* has only one piston 84*a* disposed within a cylinder 112*a*. The piston rod 81*a* of the valve actuator is coupled end to end to the valve stem 80*a* within the filling head. A compression spring 138*a* acts on the piston 84*a* to normally hold the valve member 82*a* in the illustrated fully closed position. Upon introduction of pressurized air into the lower chamber within the cylinder 112*a*, the piston 84*a* travels upwardly against the bias of the spring 138*a* to move the valve member 82*a* to the fully open position.

Provided in the conduit system 74, extending from the surge tank 76 to the fluid inlet 104*a* of the filling head 92*a*, is the three-position flow control valve 250 for controlling the flow rate of the fluid to be packaged. This flow control valve assumes three positions, fully open, half open and fully closed, under the control of the valve actuator 252. The configuration of the valve actuator 252 can be identical with that of the dual piston valve actuator 93, FIG. 7, used in combination with the filling head 92. A practical form of installation of the flow control valve 250 and the valve actuator 252 is shown in phantom line in FIG. 4.

In operation, both the filling head 92*a* and the flow control valve 250 are held fully open while the bag is being bulk filled, with its spout pressed against the filling head. Upon completion of the bulk filling operation, the dual piston valve actuator 252 causes the flow control valve 250 to shift from its fully open to half open position, so that the fluid starts flowing into the filling head 92*a* at a reduced rate. The filling head itself is left fully open.

Almost immediately after the actuation of the flow control valve 250 from the fully open to half open position, the spout of the bag is lowered a predetermined slight distance away from the filling head 92*a*. The bag continues to be filled with the fluid from the filling head, this time in the makeup filling mode, until the fluid within the bag reaches the prescribed weight. Thereupon the valve actuator 93*a* closes the filling head.

It will have been seen that the modified filling valve assembly 30*a* performs merely the on-off control of the fluid flow therethrough. The required reduction of the flow rate is accomplished by the three-position flow control valve 250 disposed upstream of the filling head 92*a*. No undesired change in fluid pressure takes place within the filling head, so that the spout of the bag being filled can be moved out of contact therewith immediately after the transition from the bulk filling to makeup filling mode, without giving rise to the possibility of the fluid rushing out of the filling head.

What is claimed is:

1. A contamination-free method of filling bags with a fluid product to a prescribed weight, each bag having a spout openably closed with a cap, which method comprises:

(a) providing a filling valve assembly and a cap remover assembly in fixed positions and in side-by-side relation in a germfree chamber, the filling valve assembly having a filling head for downwardly dispensing the fluid product through an opening in the bottom of the chamber;

(b) providing a weighing platform under the germfree chamber;

(c) sterilizing at least the germfree chamber and the interior of the filling head;

(d) supporting a bag on said weighing platform while holding the spout of a bag in a first position substantially within the chamber;

(e) removing the cap from the spout of the bag in the first position by the cap remover assembly;

(f) carrying the open spout of the bag to a second position substantially within the chamber and under the filling head while the bag is supported on the weighing platform;

(g) raising the spout into engagement with the filliing head located above the spout and charging the fluid product into the bag from the filling head through the open spout to an extent less than the prescribed weight while the spout of the bag is being held against the filling head;

(h) lowering the spout of the bag from the filling head to said second position to disengage the spout from the filling head and to freely rest the bag on the weighing platform;

(i) further charging the fluid product into the bag from the filling head to the prescribed weight, as ascertained by the weighing platform, while the spout of the bag is being held at a slight distance from the filling head;

(j) carrying the spout of the filled bag back to the first position;

(k) reclosing the spout of the bag with the cap by the cap remover assembly; and (l) introducing sterilized air under pressure into the germfree chamber at least throughout the steps (d) through (k), inclusive, to maintain the chamber at a higher-than-atmospheric pressure.

2. The method of claim 1, wherein the germfree chamber is sterilized by:

(a) heating the chamber by passing heated, sterilized air therethrough;

(b) hermetically closing the heated chamber;

(c) introducing a sterilizing liquid in subdivided form into the heated, closed chamber;

(d) passing heated, sterilized air into and out of the chamber for exhausting the sterilizing liquid therefrom and for drying the chamber; and (e) opening the chamber.

3. The method of claim 2, wherein the sterilizing liquid is a hydrogen peroxide solution.

4. The method of claim 3, wherein the concentration of hydrogen peroxide in the solution is about 35%.

5. The method of claim 2, 3 or 4, wherein the heated, sterilized air is continuously introduced into the germfree chamber even after the chamber is opened, and as long as the filling operation of the bags proceeds.

6. The method of claim 1, wherein the germfree chamber is sterilized by introducing sterilized steam into the chamber while the latter is closed.

7. The method of claim 6, wherein the pressure and temperature in the chamber are controlled by adjusting a pressure control valve provided in a drain conduit connected to the chamber.

8. The method of claim 6, wherein a part of the steam is introduced through the interior of the filling head.

9. The method of claim 1, wherein the interior of the filling head is sterilized by passing steam therethrough under increased pressure.

10. The method of claim 1, wherein the fluid product is charged into the bag at a higher rate when the spout of the bag is held against the filling head than when the spout is held at the slight distance therefrom.

11. The method of claim 8, wherein the spout of the bag is separated from the filling head, to be held at the slight distance therefrom, immediately after the reduction of the rate at which the fluid product is charged into the bag.

12. The method of claim 1, which further comprises sterilizing at least the spout of the bag being held in the first position on the weighing platform, before the cap is removed therefrom.

13. The method of claim 12, wherein the spout of the bag is sterilized with a spray of chlorine water.

* * * * *